US011850531B2

(12) United States Patent
Chen

(10) Patent No.: US 11,850,531 B2
(45) Date of Patent: Dec. 26, 2023

(54) ROLLABLE TOY CAR

(71) Applicant: Cheng Chen, Shantou (CN)

(72) Inventor: Cheng Chen, Shantou (CN)

( * ) Notice: Subject to any disclaimer, the term of this patent is extended or adjusted under 35 U.S.C. 154(b) by 57 days.

(21) Appl. No.: 18/111,535

(22) Filed: Feb. 18, 2023

(65) Prior Publication Data

US 2023/0201731 A1 Jun. 29, 2023

(51) Int. Cl.
*A63H 17/26* (2006.01)
*A63H 29/22* (2006.01)
*A63H 31/00* (2006.01)

(52) U.S. Cl.
CPC ..... *A63H 17/26* (2013.01); *A63H 29/22* (2013.01); *A63H 31/00* (2013.01)

(58) Field of Classification Search
CPC ..... A63H 17/02; A63H 17/16; A63H 17/26; A63H 29/00; A63H 31/00
USPC ..... 446/71, 79, 88, 93, 94, 95, 465, 471
See application file for complete search history.

(56) References Cited

U.S. PATENT DOCUMENTS 2,577,102 A * 12/1951 Bolger ..... A63H 33/007 446/449
5,129,851 A * 7/1992 Villanueva ..... A63H 33/003 446/469
5,609,510 A * 3/1997 Stubenfoll ..... A63H 17/26 446/470
6,227,934 B1 * 5/2001 Isaksson ..... A63H 17/004 446/470
6,394,876 B1 * 5/2002 Ishimoto ..... A63H 17/004 446/469
7,033,241 B2 * 4/2006 Lee ..... A63H 17/004 446/470
8,348,715 B2 * 1/2013 Miyake ..... A63H 17/02 446/321
8,814,629 B2 * 8/2014 Johnston ..... A63H 17/02 446/431
9,352,242 B2 * 5/2016 Rehkemper ..... A63H 30/04
9,370,725 B2 * 6/2016 Choi ..... A63F 1/04
9,579,583 B2 * 2/2017 Sheltman ..... A63H 17/008
9,931,580 B2 * 4/2018 Rehkemper ..... A63H 1/02
10,207,194 B2 * 2/2019 Sheltman ..... A63H 17/26
10,413,103 B1 * 9/2019 Balanchi ..... A63H 33/003
10,421,028 B2 * 9/2019 Choi ..... A63H 17/02
D977,582 S * 2/2023 Chen ..... D21/427
2005/0148282 A1 * 7/2005 Moll ..... A63H 29/22 446/456
2015/0093962 A1 4/2015 Silverglate et al.
2017/0189821 A1 7/2017 Cai
2019/0060772 A1 2/2019 Hamel et al.

* cited by examiner

*Primary Examiner* — Joseph B Baldori
(74) *Attorney, Agent, or Firm* — Jose Cherson Weissbrot

(57) ABSTRACT

A rollable toy car of the present disclosure relates to the technical field of toys. The rollable toy car includes a car body device, a rolling device arranged on the car body device, and a transformation actuating device arranged on the car body device, wherein a transformation actuator actuates a first car body to rotate by means of a first gear set; the transformation actuator actuates a third car body to rotate by means of a third gear set; and a first rolling frame is driven to rotate by the first car body, and a third rolling frame is driven to rotate by the third car body, so that the first rolling frame, a second rolling frame and the third rolling frame are jointly enclosed into a rollable shape.

10 Claims, 9 Drawing Sheets

ROLLABLE TOY CAR

TECHNICAL FIELD

The present disclosure relates to the technical field of toys, in particular, to a rotary actuating device and a rollable toy car.

BACKGROUND

Rollable toy car refers to a toy car that can be deformed and can perform a rolling action in one of its forms. In order to realize a rolling action of a toy car, it is usually necessary to actuate, by using a motor, the whole toy car to curl up or be assembled, so that the toy car can be transformed into a shape conducive for rolling, and is then actuated to somersault by using a power mechanism.

However, a car body of the rollable toy car in the prior art usually only includes two portions. The two portions of the car body will be assembled when the toy car needs to be transformed to the form that is conducive for rolling. However, although the form of the whole toy car after assembling is more conducive for rolling than a form before assembling, the rollable toy car after assembling still has a problem of rolling obstruction. A specific reason is that the whole toy car after assembling cannot present a form that is more conducive for rolling.

SUMMARY

In order to solve or partially solve the problems in the prior art, the present disclosure provides a rollable toy car, which can avoid the problem of rolling obstruction.

The present disclosure provides a rollable toy car, including a car body device, a rolling device arranged on the car body device, and a transformation actuating device arranged on the car body device.

The car body device includes a first car body, a second car body and a third car body which are connected in sequence; and the second car body is rotatably connected with the first car body and the third car body respectively.

The rolling device includes a first rolling frame arranged on the first car body, a second rolling frame arranged on the second car body, and a third rolling frame arranged on the third car body.

The transformation actuating device includes a transformation actuator arranged on the second car body, a transformation actuating gear connected with the transformation actuator, a first gear set that is arranged on the second car body and is connected with the first car body, and a third gear set that is arranged on the second car body and is connected with the third car body; and the first gear set and the third gear set are respectively meshed with the transformation actuating gear.

The transformation actuator actuates the first car body to rotate by means of the first gear set; the transformation actuator actuates the third car body to rotate by means of the third gear set; and a first rolling frame is driven to rotate by the first car body, and the third rolling frame is driven to rotate by the third car body, so that the first rolling frame, the second rolling frame and the third rolling frame are jointly enclosed into a rollable shape.

In some embodiments, the rolling device further includes a second curved plate rotatably connected to the second rolling frame, and a third curved plate rotatably connected to the third rolling frame.

The second curved plate slidably abuts against an upper surface of the first car body; the third curved plate slidably abuts against an upper surface of the second car body; and the second curved plate, the third curved plate, the first rolling frame, the second rolling frame and the third rolling frame are jointly enclosed into the rollable shape.

In some embodiments, the rollable shape is a circular-ring shape or is similar to a circular-ring shape.

In some embodiments, the upper surface of the first car body has a first curved surface; the upper surface of the second car body has a second curved surface; and an upper surface of the third car body has a third curved surface.

The first rolling frame is disposed along a contour of the first curved surface; the second rolling frame is disposed along a contour of the second curved surface; and the third rolling frame is disposed along a contour of the third curved surface.

In some embodiments, the third rolling frame includes a third left arc track and a third right arc track which are parallel to each other; and the third left arc track and the third right arc track are respectively arranged on the upper surface of the third car body.

The second rolling frame includes a second left arc track and a second right arc track which are parallel to each other; and the second left arc track and the second right arc track are respectively arranged on the upper surface of the second car body.

The third rolling frame includes a third left arc track and a third right arc track which are parallel to each other; and the third left arc track and the third right arc track are respectively arranged on the upper surface of the third car body.

The second curved plate is located between the first left arc track and the first right arc track; and the third curved plate is located between the second left arc track and the second right arc track.

In some embodiments, the second car body is provided with at least one side-tumbling flange; and a thickness of the side-tumbling flange gradually decreases along a direction away from the second car body to form a side inclination slope.

In some embodiments, the rollable toy car further includes a turning actuating device; and the turning actuating device includes a turning actuating motor, a turning actuating gear that is in actuating connection to the turning actuating motor, and a turning wobble gear meshed with the turning actuating gear, a turning member slidably pressing against the turning wobble gear, and a turning wheel arranged on the turning member.

The actuating motor actuates the turning wobble gear to rotate by means of the turning actuating gear; the turning wobble gear drives the turning member to rotate; and the turning wheel is driven to rotate by the turning member;

The actuating motor and the turning member are respectively arranged on the first car body, or the actuating motor and the turning member are respectively arranged on the third car body.

In some embodiments, a sliding rod is arranged on the turning member; and the sliding rod is arranged in the turning wobble gear in a penetrating manner.

When the turning wobble gear rotates, the sliding rod drives the turning member to rotate under the actuation of the turning wobble gear.

In some embodiments, the turning wobble gear includes a fan-shaped plate, and turning wobble teeth arranged at an edge of the fan-shaped plate.

The fan-shaped plate is connected to the first car body or the third car body through a rotating shaft; and the turning wobble teeth are meshed with the turning actuating gear.

In some embodiments, the rollable toy car further includes a movement actuating device used for actuating the car body device to move.

The movement actuating device includes a movement actuator, and a movement wheel that is in actuating connection to the movement actuator; and the movement actuator actuates the movement wheel to rotate.

The movement actuator and the movement wheel are arranged on the first car body, or the movement actuator and the movement wheel are arranged on the third car body.

The technical solutions provided by the present disclosure can include the following beneficial effects:

The rollable toy car of the present disclosure relates to the technical field of toys. On the rollable toy car, the transformation actuating device actuates the entire car body device to curl into a shape suitable for rotation. Specifically, the first car body and the third car body can be enabled to respectively rotate relative to a second car body, thereby driving the first rolling frame and the third rolling frame to respectively rotate, and finally, the first rolling frame, the second rolling frame and the third rolling frame are jointly enclosed into the rollable shape.

It should be understood that the above general description and the following detailed description are exemplary and explanatory only, and are not intended to limit the present disclosure.

BRIEF DESCRIPTION OF THE DRAWINGS

The above and other purposes, features and advantages of the present disclosure will become more apparent through a more detailed description of the exemplary embodiments of the present disclosure in combination with the accompanying drawings. In the exemplary embodiments of the present disclosure, the same reference numerals usually represent the same components.

DETAILED DESCRIPTION OF THE EMBODIMENTS

Figure 1:
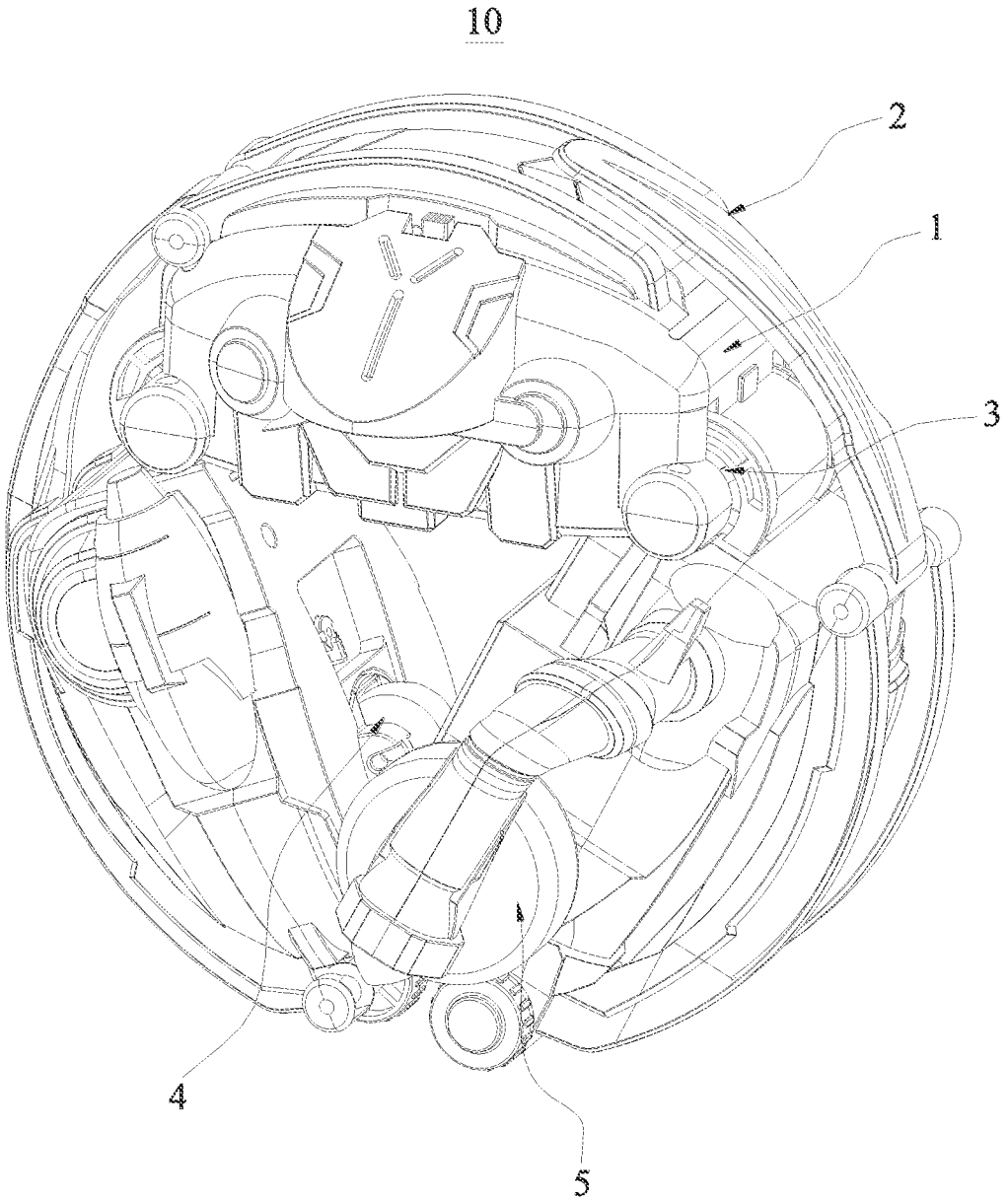
FIG. 1 is a schematic structural diagram of a rollable toy car provided by the embodiments of the present disclosure.

Implementations of the present disclosure will be described in more detail below with reference to the accompanying drawings. Although the implementations of the present disclosure are shown in the drawings, it should be understood that the present disclosure can be implemented in various forms and should not be limited by the implementations set forth herein. On the contrary, these implementations are provided to enable a more thorough and complete understanding of the present disclosure and to fully deliver the scope of the present disclosure to those skilled in the art.

It should be understood that although the terms "first", "second", "third", etc. may be used to describe various kinds of information in the present disclosure, the information should not be limited to these terms. These terms are only used to distinguish the same type of information from each other. For example, the first information can also be referred to as the second information without departing from the scope of the present disclosure. Similarly, the second information can also be referred to as the first information. Therefore, features defined by "first" and "second" can explicitly instruct or impliedly include one or more features. In the description of the present utility model, unless expressly specified otherwise, the meaning of the "plurality" is two or more than two.

In the description of the present utility model, it should be understood that orientations or positional relationships indicated by the terms "length", "width", "upper", "lower", "front", "rear", "left", "right", "vertical", "horizontal", "top", "bottom", "inside", "outside" and the like are orientations or positional relationships as shown in the drawings, and are only for the purpose of facilitating and simplifying the description of the present utility model instead of indicating or implying that devices or elements indicated must have particular orientations, and be constructed and operated in the particular orientations, so that these terms are not construed as limiting the present utility model.

Unless otherwise clearly specified and defined, the terms "mounted", "connected", "coupled", "fixed", and the like should be understood in a broad sense, for example, it can be a fixed connection, a detachable connection, or integrated. It can be a mechanical connection or an electrical connection. It can be a direct connection, or an indirect connection through an intermediate medium. It can also be an internal connection between two components or the interaction between two components. Those of ordinary skill in the art can understand the specific meanings of the above terms in the present utility model according to specific situations.

Figure 2:
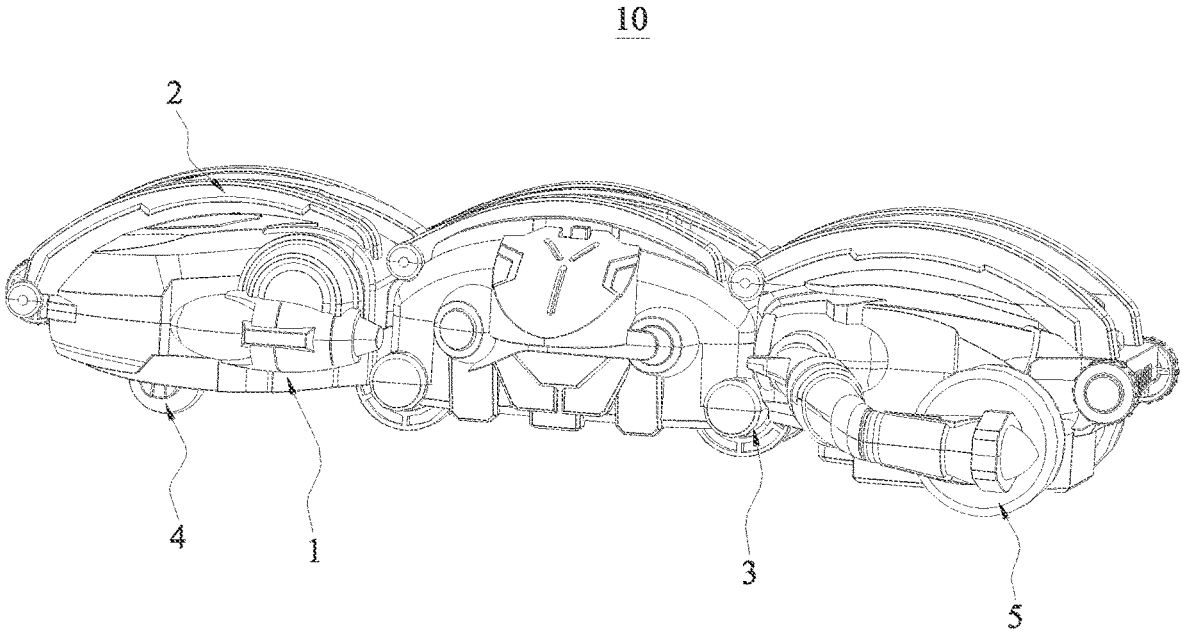
FIG. 2 is another schematic structural diagram of a rollable toy car shown in an embodiment of the present disclosure.

FIG. 1 and FIG. 2 show a toy car 10 for rolling in some preferred embodiments of the present disclosure. The toy car 10 for rolling can be transformed and can roll or move in different forms.

As shown in FIG. 1 to FIG. 5, the toy car 10 for rolling includes a car body device 1, a rolling device 2 and a transformation actuating device 3. The car body device 1 is used for form transformation, and is also used for mounting other devices. The rolling device 2 is arranged on the car body device 1. The rolling device 2 is driven by the car body device 1 to perform the form transformation, so that the rolling device 2 can be transformed into a shape more suitable for rolling. The transformation actuating device 3 is arranged on the car body device 1. The transformation actuating device 3 is used for actuating the car body device 1 to be transformed.

As shown in FIG. 3 to FIG. 9, the car body device 1 includes a first car body 11, a second car body 12 and a third car body 13 which are connected in sequence. The second car body 12 is rotatably connected with the first car body 11 and the third car body 13 respectively.

It can be understood that the first car body 11 and the second car body 12 can be connected by means of a rotating shaft or other rotatable connection structure. The third car body 13 and the second car body 12 can be connected by means of a rotating shaft or other rotatable connection structures. The second car body 12 is located between the first car body 11 and the third car body 13, and the first car body 11, the second car body 12 and the third car body 13 are arranged in the same direction.

It should be noted that contours of the first car body 11, the second car body 12 and the third car body 13 can all be flexibly set, and can be the same or different.

The rolling device 2 includes a first rolling frame 21 arranged on the first car body 11, a second rolling frame 22 arranged on the second car body 12, and a third rolling frame 23 arranged on the third car body 13.

It can be understood that the first rolling frame 21, the second rolling frame 22 and the third rolling frame 23 can be enclosed into a shape more favorable for rolling.

The transformation actuating device 3 includes a transformation actuator 31 arranged on the second car body 12, a transformation actuating gear 32 connected with the transformation actuator 31, a first gear set 33 that is arranged on the second car body 12 and is connected with the first car body 11, and a third gear set 34 that is arranged on the second car body 12 and is connected with the third car body 13; and the first gear set 33 and the third gear set 34 are respectively meshed with the transformation actuating gear 32.

It can be understood that the transformation actuator 31 is used for actuating the transformation actuating gear 32. The transformation actuating gear 32 is used for transferring a torque to the first gear set 33 and the third gear set 34 respectively, so that the first gear set 33 drives the first car body 11 and the second car body 12 to rotate relatively, and the third gear set 34 drives the third car body 13 and the second car body 12 to rotate relatively. In this way, the car body device 1 is transformed between a spread state and a curled state.

In a use process, the transformation actuator 31 actuates the first car body 11 to rotate by means of the first gear set 33; the transformation actuator 31 actuates the third car body 13 to rotate by means of the third gear set 34; and a first rolling frame 21 is driven to rotate by the first car body 11, and the third rolling frame 23 is driven to rotate by the third car body 13, so that the first rolling frame 21, the second rolling frame 22 and the third rolling frame 23 are jointly enclosed into a rollable shape.

It can be understood that in the rollable shape, the first rolling frame 21, the second rolling frame 22 and the third rolling frame 23 will surround, to a certain extent, the car body device 1 in the curled state. That is, the car body device 1 will be located in the shape enclosed by the first rolling frame 21, the second rolling frame 22 and the third rolling frame 23. Of course, the transformation actuating device 3 will also be located in the shape enclosed by the rolling device 2. In this way, in the rolling process, the rolling device 2 will be preferentially in contact with the ground, a tabletop or other surfaces that support the product to roll, thus driving the whole car body device 1 to roll. Thus, obstruction, caused by the car body device 1 or the transformation actuating device 3, to a product in the rolling process can be avoided, and smooth rolling is guaranteed.

It should be noted that after the rolling device 2 is enclosed into the rollable shape, the transformation actuating device 3 can actuate the car body device 1 to be transformed again, so that the first car body 11 and the second car body 13 rotate respectively, and the first car body 11, the second car body 12 and the third car body 13 spread again to relieve the enclosure of the rolling device 2.

It should also be noted that the transformation actuator 31 may be a motor. Shapes of the first rolling frame 21, the second rolling frame 22 and the third rolling frame 23 can be flexible set, and can be the same or different, as long as the three frames can be enclosed to form the shape convenient for rolling.

Specifically, the rollable shape is a circular-ring shape or is similar to a circular-ring shape.

It can be understood that either the circular-ring shape or the shape similar the circular-ring shape is favorable for the rolling of the product, which avoids the obstruction to the rolling of the product.

As shown in FIG. 3 to FIG. 8, in some embodiments, the rolling device 2 further includes a second curved plate 24 rotatably connected to the second rolling frame 22, and a third curved plate 25 rotatably connected to the third rolling frame 23.

The second curved plate 24 slidably abuts against an upper surface of the first car body 11; the third curved plate 25 slidably abuts against an upper surface of the second car body 12; and the second curved plate 24, the third curved plate 25, the first rolling frame 21, the second rolling frame 22 and the third rolling frame 23 are jointly enclosed into the rollable shape.

It can be understood that both the second curved plate 24 and the third curved plate 25 are used for making the entire rolling device 2 more favorable for rolling. A radian of the third curved plate 25 matches a contour of the upper surface of the second car body 12.

It should be noted that when the first car body 11 rotates relative to the second car body 12, rotatable connection positions of the first car body 11 and the second car body 12 will be in fit clearance, and the fit clearance is outwards. Since the fit clearance exists, the shape that is enclosed by the rolling device 2 and is favorable for rolling has a large notch. It is easy for the product to get stuck when the product rolls to the notch position. By the arrangement of the second curved plate 24, a cover to a certain extent can be formed on an outermost side of the clearance. In the rolling process, the second curved plate 24 will avoid that the product gets stuck during rolling due to the clearance. Similarly, the arrangement of the third car body 13 can avoid that the product gets stuck in the rolling process due to the fit clearance between the second car body 12 and the third car body 13.

It is also noted that in the spreading process of the product, the second curved plate 24 may slide along the upper surface of the first car body 11. Therefore, the radian of the second curved plate 24 is set to match the contour of the upper surface of the first car body 11, which can avoid an obstruction and the like between the second curved plate 24 and the first car body 11. Similarly, the radian of the third curved plate 25 is preferably set to match the contour of the upper surface of the second car body 12.

Figure 3:
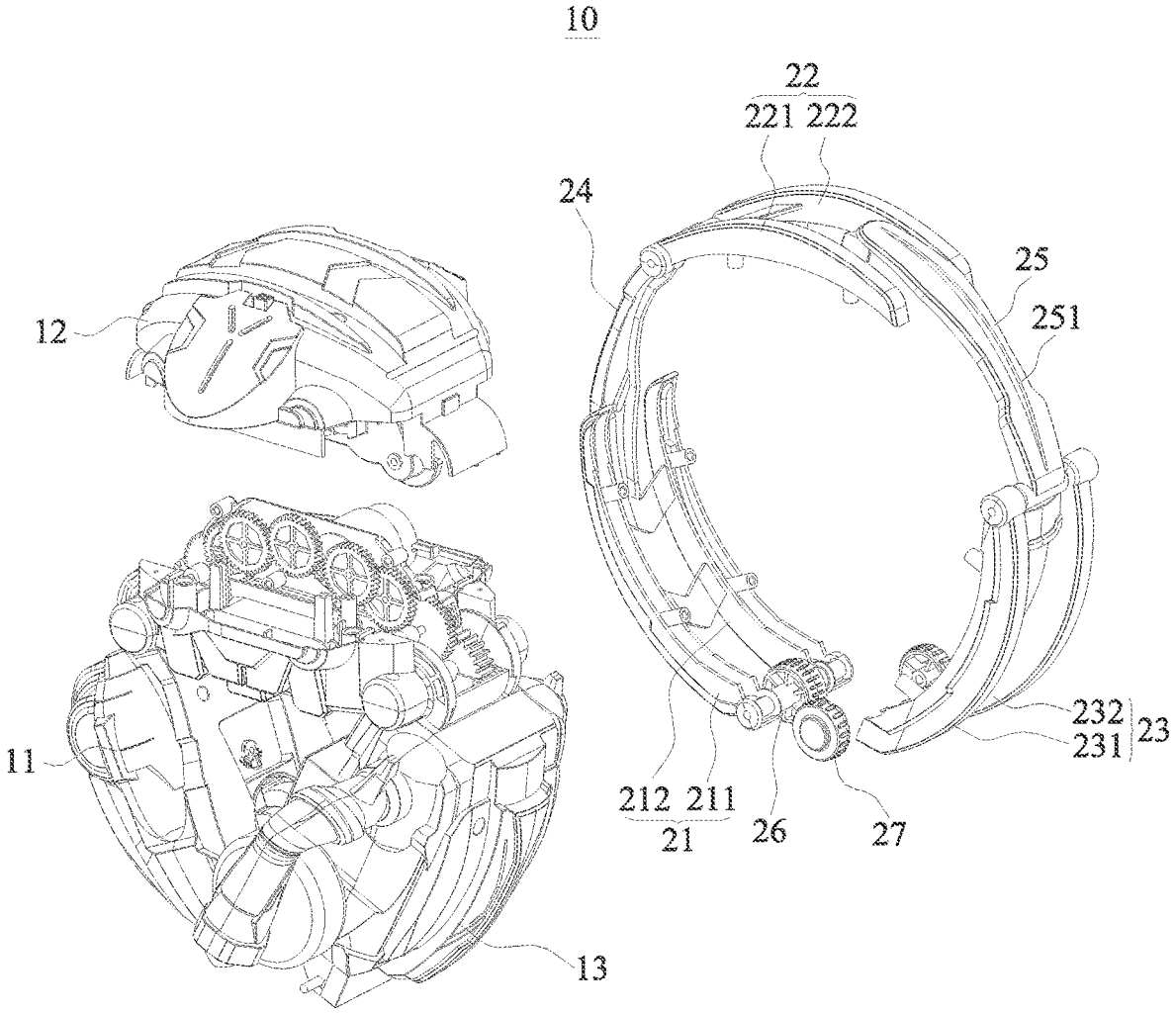
FIG. 3 is an exploded diagram of the rollable toy car shown in FIG. 1.
Figure 4:
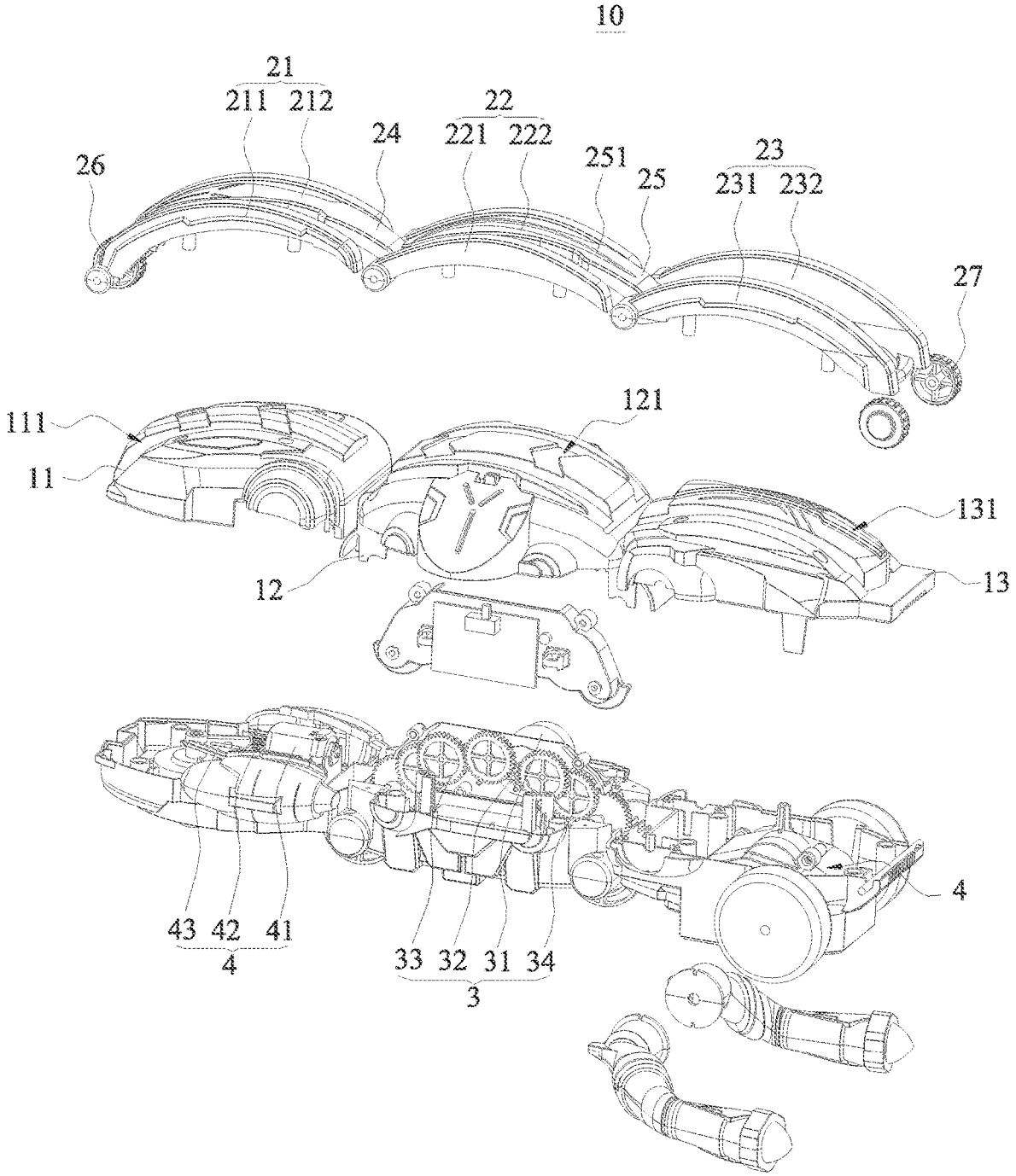
FIG. 4 is an exploded diagram of the rollable toy car shown in FIG. 2.
Figure 5:
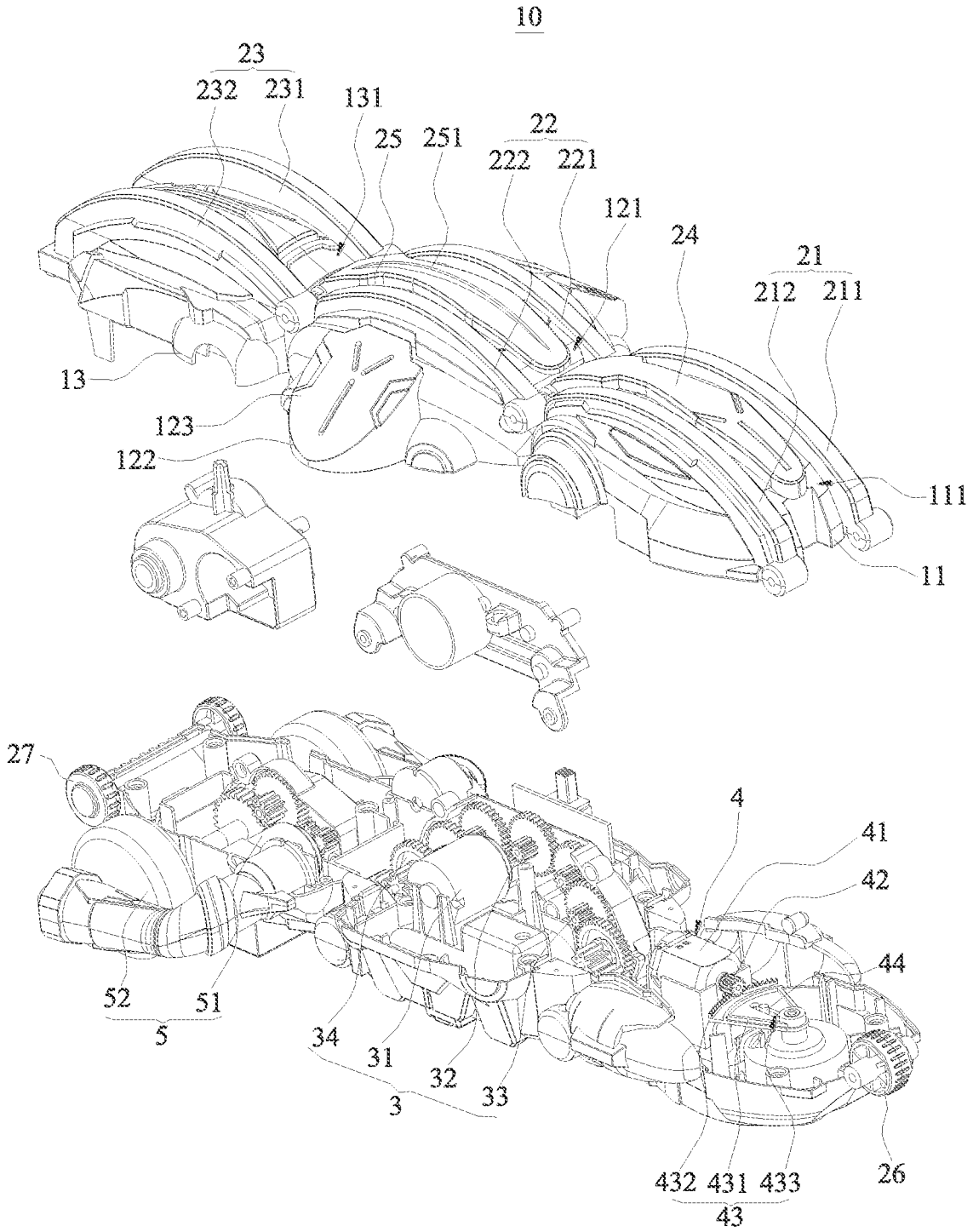
FIG. 5 is another exploded diagram of the rollable toy car shown in FIG. 2.
Figure 6:
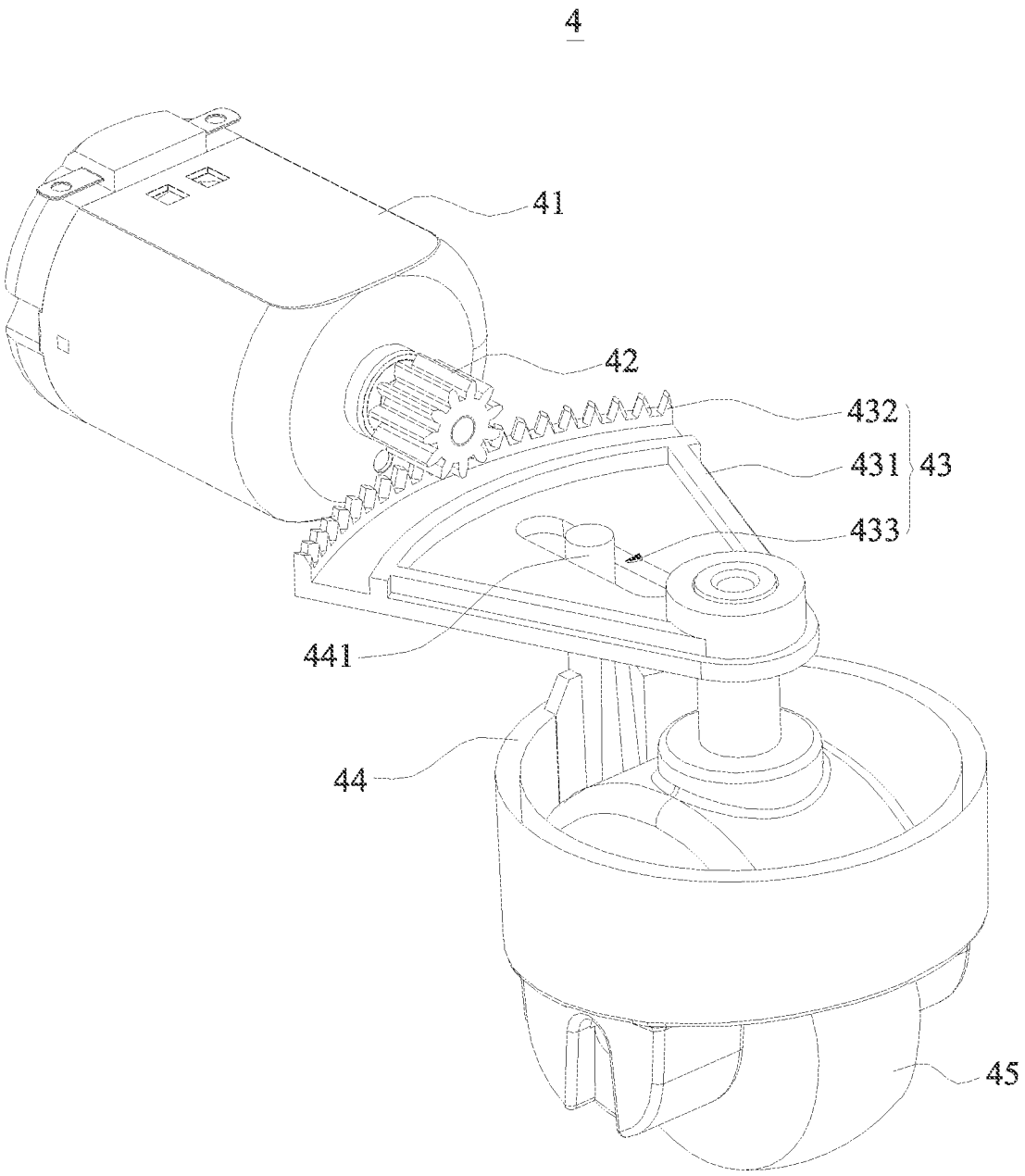
FIG. 6 is a schematic structural diagram of a turning actuating device shown in an embodiment of the present disclosure.
Figure 7:
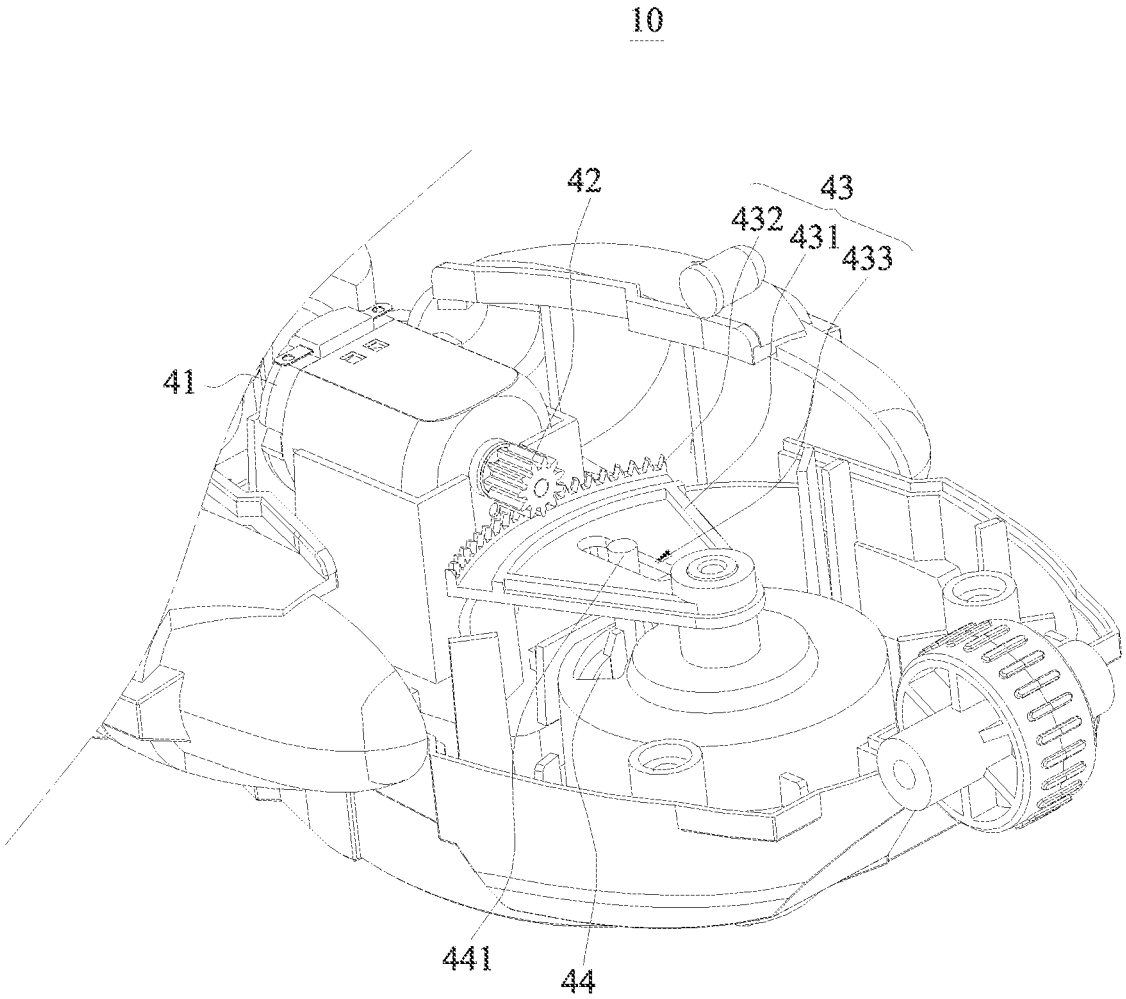
FIG. 7 is another schematic structural diagram of a turning actuating device shown in an embodiment of the present disclosure.
Figure 8:
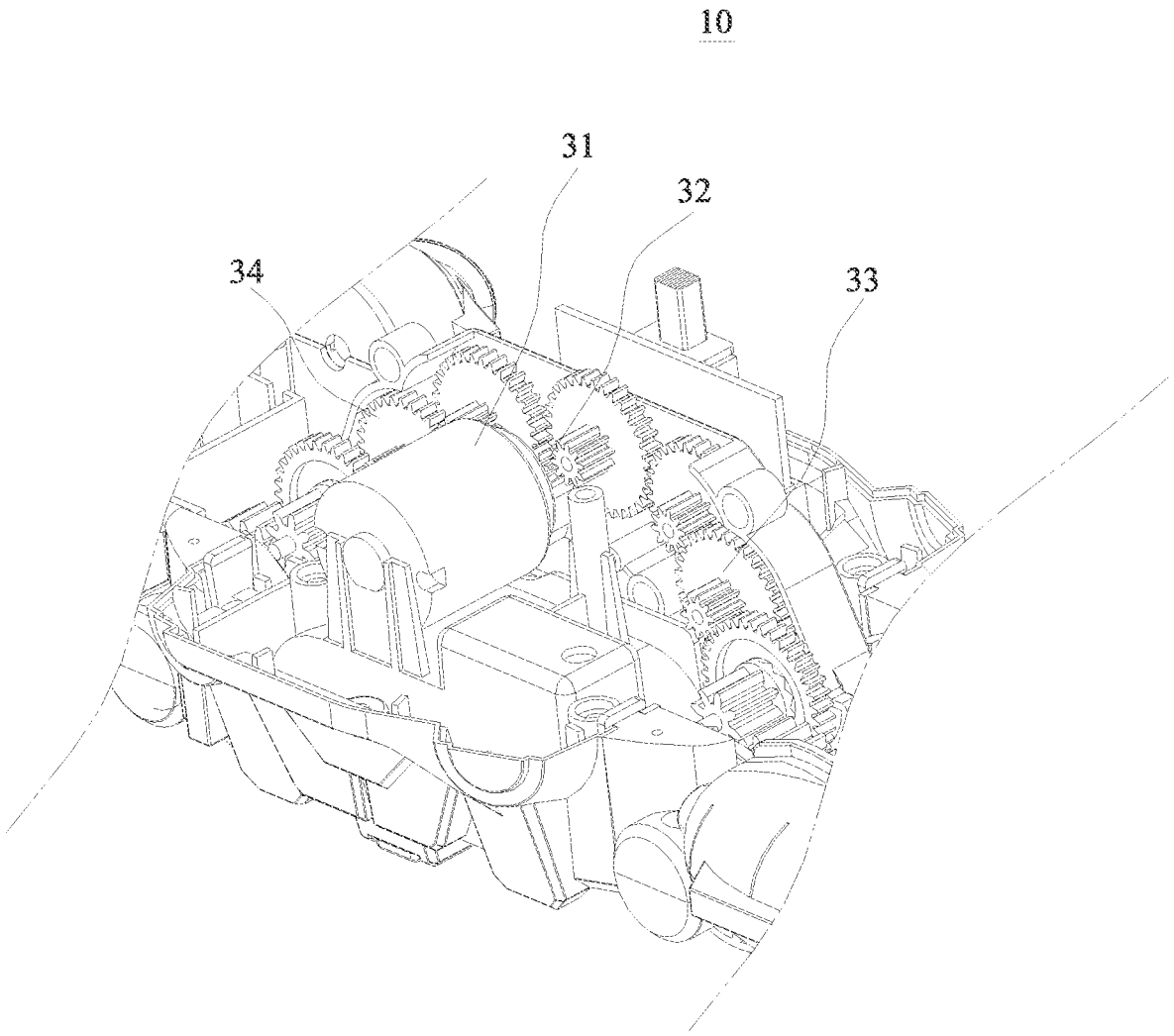
FIG. 8 is a schematic structural diagram of a transformation actuating device shown in an embodiment of the present disclosure.

As shown in FIG. 3 to FIG. 5, in some embodiments, the third curved plate 25 is provided with a side-tumbling lug boss 251.

It can be understood that when the third curved plate 25 faces the ground or a tabletop, the side-tumbling lug boss 251 is preferentially in contact with the tabletop or the ground, so that the product rolls. The product after rolling can stand on the tabletop or the ground in a correct posture after being transformed to an extended state.

As shown in FIG. 3 to FIG. 8, in some embodiments, the upper surface of the first car body 11 has a first curved surface 111; the upper surface of the second car body 12 has a second curved surface 121; an upper surface of the third car body 13 has a third curved surface 131. The first rolling frame 21 is disposed along a contour of the first curved surface 111; the second rolling frame 22 is disposed along a contour of the second curved surface 121; and the third rolling frame 23 is disposed along a contour of the third curved surface 131.

It can be understood that curvatures of the first curved surface 111, the second curved surface 121 and the third curved surface 131 are the same or close, so that the rolling frames disposed along the contours of the various curved surfaces can be enclosed into the circular-ring shape, or are enclosed into the circular-ring shape as much as possible.

It should be noted that when product is transformed into the rollable shape, the first curved surface 111, the second curved surface 121 and the third curved surface 131 all face the outside, and lower surfaces of the various car bodies all face the inside.

As shown in FIG. 3 to FIG. 5, in some embodiments, the first rolling frame 21 includes a first left arc track 211 and a first right arc track 212 which are parallel to each other; and the first left arc track 211 and the first right arc track 212 are respectively arranged on the upper surface of the third car body 11.

The second rolling frame 22 includes a second left arc track 221 and a second right arc track 222 which are parallel to each other; and the second left arc track 221 and the second right arc track 222 are respectively arranged on the upper surface of the second car body 12.

The third rolling frame 23 includes a third left arc track 231 and a third right arc track 232 which are parallel to each other; and the third left arc track 231 and the third right arc track 232 are respectively arranged on the upper surface of the third car body 13.

The second curved plate 24 is located between the first left arc track 211 and the first right arc track 212; and the third curved plate 25 is located between the second left arc track 221 and the second right arc track 222.

It can be understood that both the first left arc track 211 and the first right arc track 212 have certain radians, may have the same or different lengths, and may be preferentially in contact with the ground, the tabletop or other surfaces that support the product to roll.

Similarly, contours of the second left arc track 221 and the second right arc track 222, and contours of the third left arc track 231 and the third right arc track 232 may all be set with reference to the first left arc track 211 and the first right arc track 212, and descriptions thereof will be omitted.

It should be noted that in the transformation process, the second curved plate 24 will slide between the first left arc track 211 and the first right arc track 212, and the third curved plate 25 will slide between the second left arc track 221 and the second right arc track 222. In the rolling process, the various curved plates, the various curved plates, the various left arc tracks and the various right arc tracks all play a role of supporting the product to roll.

As shown in FIG. 5, the second car body 12 is provided with at least one side-tumbling flange 122; and a thickness of the side-tumbling flange 122 gradually decreases along a direction away from the second car body 12 to form a side inclination slope 123.

It can be understood that when the product spreads from the curled state easy for rolling, the side-tumbling flange 122 can ensure that the product turns over, during which, the side inclination slope 123 will be preferentially in contact with the ground. When the side inclination slope 123 is in complete contact with the ground, the product already has a large inertia for side tumbling and has a large overall side inclination extent, so that the product can turn over successfully to make bottom surfaces of the first car body 11, the second car body 12 and the third car body 13 downwards, and be successfully transformed to a correct spread form.

It should be noted that a quantity of the side-tumbling flange 122 can be set to be two or more. When the quantity is even, the side-tumbling flanges 122 are preferably symmetrically arranged on left and right sides of the second car body 12, so that the product can be successfully transformed no matter which side to which the product tilts.

As shown in FIG. 1 to FIG. 5, in some embodiments, the rolling device 2 further includes at least one first roller 26 arranged on the first rolling frame 21 or the first car body 11, and at least one third roller 27 arranged on the third rolling frame 23 or the third car body 13. The first roller 26 and the third roller 27 are respectively driven by the first car body 11 and the third car body 13 to get close to each other.

It can be understood that the first roller 26 is used for supporting the car body to roll. In the transformation process, an end portion of the first car body 11 away from the second car body 12 will be preferentially in contact with the ground or the tabletop. As a result, the end portion is easily excessively worn and even damaged. By the arrangement of the first roller 26, in the transformation process, the first roller will be in contact with the ground or the tabletop before the end portion. As the first roller 26 rotates, the product spreads or is curled to be closed.

Similarly, the third roller 27 can avoid an end portion of the third car body 13 away from the second car body 12 from being excessively worn, and can also avoid the end portion from being stuck by an extremely high friction force between the end portion and the tabletop or the ground, so that the durability and the transformation smoothness of the product are improved.

As shown in FIG. 1 to FIG. 7, in some embodiments, the rollable toy car 10 further includes a turning actuating device 4. The turning actuating device 4 is used for actuating the rollable toy car 10 to turn.

The turning actuating device 4 includes a turning actuating motor 41, a turning actuating gear 42 that is in actuating connection to the turning actuating motor 41, a turning wobble gear 43 meshed with the turning actuating gear 42, a turning member 44 slidably pressing against the turning wobble gear 43, and a turning wheel 45 arranged on the turning member 44.

The actuating motor actuates the turning wobble gear 43 to rotate by means of the turning actuating gear 42; the turning wobble gear 43 drives the turning member 44 to rotate; the turning wheel 45 is driven to rotate by the turning member 44; the actuating motor and the turning member 44 are respectively arranged on the first car body 11, or the actuating motor and the turning member 44 are respectively arranged on the third car body 13.

It can be understood that the turning actuating motor 41 is used for actuating the turning actuating gear 42 to rotate; the turning actuating gear 42 is used for driving the turning wobble gear 43 to wobble; the turning wobble gear 43 is used for driving the turning member 44 to rotate; the turning member 44 drives the turning wheel 45 to rotate, so that an orientation of the turning wheel 45 changes, and the rollable toy car 10 turns.

It should be noted that a transmission structure cooperating with the turning member 44 can be arranged on the turning wobble gear 43, so that the rotation of the turning wobble gear 43 can drive the turning member 44 to rotate.

Specifically, the turning actuating motor 41 may be a motor.

As shown in FIG. 4 to FIG. 7, in some embodiments, a sliding rod 441 is arranged on the turning member 44; the sliding rod 441 is arranged in the turning wobble gear 43 in a penetrating manner; and when the turning wobble gear 43 rotates, the sliding rod 441 drives the turning member 44 to rotate under the actuation of the turning wobble gear 43.

It can be understood that a slot 433 can be formed in the turning wobble gear 43. The sliding rod 441 is arranged in the slot 433 in a penetrating manner. In the rotating process of the turning wobble gear 43, since the sliding rod 441 is always limited in the slot 433, a wall of the slot 433 will push the sliding rod 441 to move towards a predetermined direction. Thus, the sliding rod 441 drives the turning member 44 to rotate to change the orientation of the turning wheel 45, which achieves the objective of reversing.

As shown in FIG. 4 to FIG. 7, in some embodiments, the turning wobble gear 43 comprises a fan-shaped plate 431, and turning wobble teeth 432 arranged at an edge of the fan-shaped plate 431; the fan-shaped plate 431 is connected to the first car body 11 or the third car body 13 through a rotating shaft; and the turning wobble teeth 432 are meshed with the turning actuating gear 42.

It can be understood that the fan-shaped plate 431 is fan-shaped, and the turning wobble teeth 432 is arranged at a round edge. There are a plurality of turning wobble teeth 432. The various turning wobble teeth 432 are disposed along an edge of the fan-shaped plate 431 in sequence.

Figure 9:
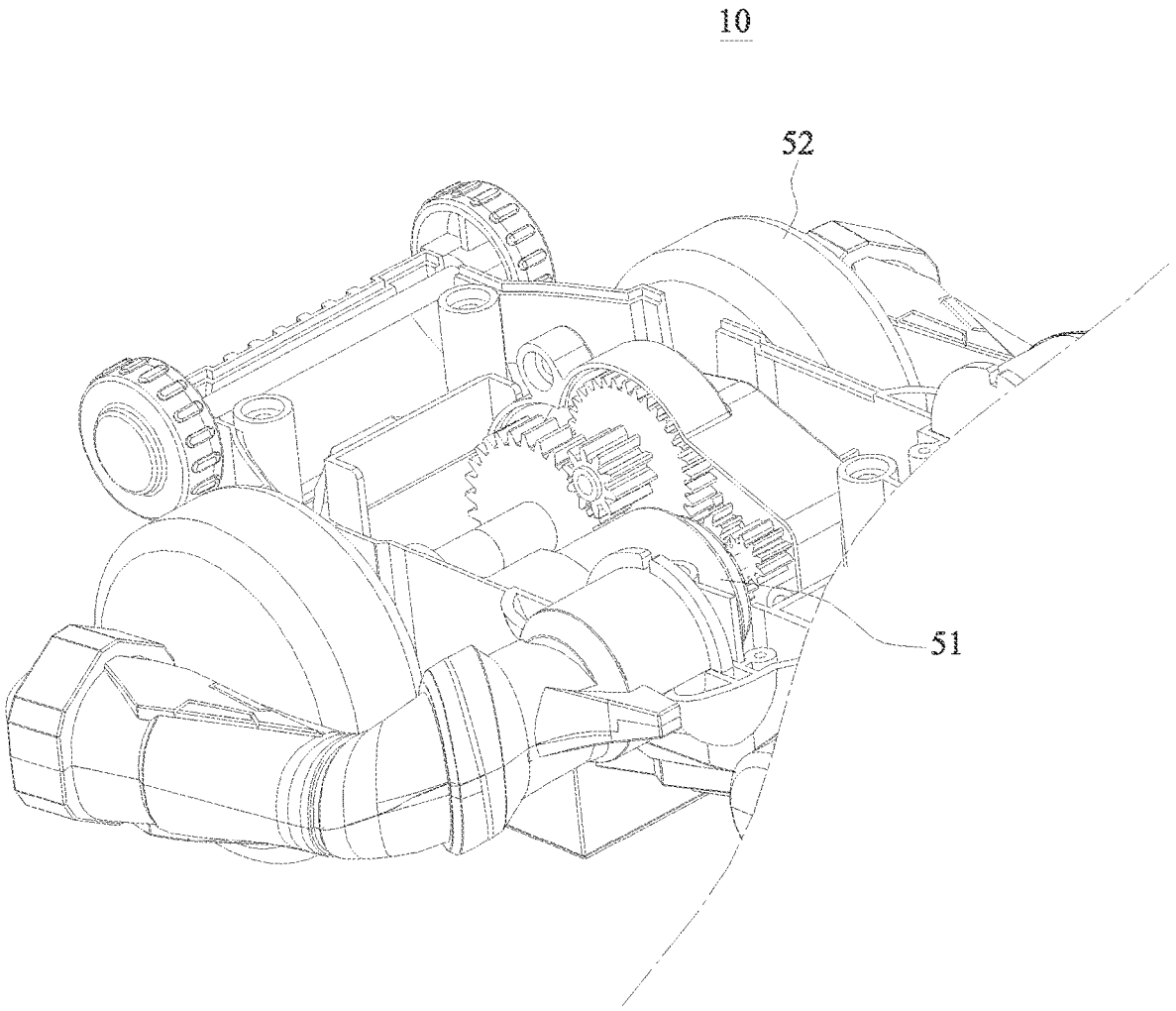
FIG. 9 is a schematic structural diagram of a movement actuating device shown in an embodiment of the present disclosure.

As shown in FIG. 1 to FIG. 3 and referring to FIG. 9 together, in some embodiments, the rollable toy car 10 further includes a movement actuating device 5 used for actuating the car body device 1 to move;

the movement actuating device 5 includes a movement actuator 51, and a movement wheel 52 that is in actuating connection to the movement actuator 51; the movement actuator 51 actuates the movement wheel 52 to rotate; and the movement actuator 51 and the movement wheel 52 are arranged on the first car body 11, or the movement actuator 51 and the movement wheel 52 are arranged on the third car body 13.

It can be understood that the movement actuator 51 is used for providing a torque to the movement wheel 52, so that the movement wheel 52 rotates to actuate the car body device 1 to move. The movement actuator 51 may be a motor. There may be a plurality of movement wheels 52. The movement actuator 51 and the movement wheel 52 can be directly connected, or may be connected by means of a gear transmission mechanism, a transmission shaft and the like.

The technical solutions provided by the present disclosure can include the following beneficial effects:

The rollable toy car of the present disclosure relates to the technical field of toys. On the rollable toy car, the transformation actuating device actuates the entire car body device to curl into a shape suitable for rotation. Specifically, the first car body and the third car body can be enabled to respectively rotate relative to a second car body, thereby driving the first rolling frame and the third rolling frame to respectively rotate, and finally, the first rolling frame, the second rolling frame and the third rolling frame are jointly enclosed into the rollable shape.

The solutions of the present disclosure have been described in detail above with reference to the accompanying drawings. In the above-mentioned embodiments, the descriptions of all the embodiments have their own focuses. For parts that are not described in detail in an embodiment, reference may be made to related descriptions of other embodiments. Those skilled in the art should also be aware that the actions and modules involved in the specification are not necessarily necessary for the present disclosure. In addition, it can be understood that the steps in the method embodiments of the present disclosure can be adjusted, combined and deleted according to actual needs, and the modules in the device embodiments of the present disclosure can be combined, divided and deleted according to actual needs.

The embodiments of the present disclosure have been described above. The above description is exemplary, not exhaustive, and are not limited to the disclosed embodiments. Without departing from the scope and spirit of all the described embodiments, many modifications and changes are obvious to those of ordinary skill in the art. The selection of terms used herein aims to best explain the principles of all the embodiments, practical applications or improvement of technologies in the market, or to enable other persons of ordinary skill in the art to understand the embodiments disclosed herein.

What is claimed is:

1. A rollable toy car, comprising a car body device, a rolling device arranged on the car body device, and a transformation actuating device arranged on the car body device, the car body device comprises a first car body, a second car body and a third car body which are connected in sequence; the second car body is rotatably connected with the first car body and the third car body respectively;

the rolling device comprises a first rolling frame arranged on the first car body, a second rolling frame arranged on the second car body, and a third rolling frame arranged on the third car body;

the transformation actuating device comprises a transformation actuator arranged on the second car body, a transformation actuating gear connected with the transformation actuator, a first gear set that is arranged on the second car body and is connected with the first car body, and a third gear set that is arranged on the second car body and is connected with the third car body; the first gear set and the third gear set are respectively meshed with the transformation actuating gear;

wherein the transformation actuator actuates the first car body to rotate by means of the first gear set; the transformation actuator actuates the third car body to rotate by means of the third gear set; and the first rolling frame is driven to rotate by the first car body, and the third rolling frame is driven to rotate by the third car body, so that the first rolling frame, the second rolling frame and the third rolling frame are jointly enclosed into a rollable shape.

2. The rollable toy car according to claim 1, wherein the rolling device further comprises a second curved plate rotatably connected to the second rolling frame, and a third curved plate rotatably connected to the third rolling frame;

the second curved plate slidably abuts against an upper surface of the first car body; the third curved plate slidably abuts against an upper surface of the second car body; and the second curved plate, the third curved plate, the first rolling frame, the second rolling frame and the third rolling frame are jointly enclosed into the rollable shape.

3. The rollable toy car according to claim 1, wherein the rollable shape is a circular-ring shape or is similar to a circular-ring shape.

4. The rollable toy car according to claim 1, wherein the upper surface of the first car body has a first curved surface; the upper surface of the second car body has a second curved surface; an upper surface of the third car body has a third curved surface;

the first rolling frame is disposed along a contour of the first curved surface; the second rolling frame is disposed along a contour of the second curved surface; and the third rolling frame is disposed along a contour of the third curved surface.

5. The rollable toy car according to claim 2, wherein the first rolling frame comprises a first left arc track and a first right arc track which are parallel to each other; the first left arc track and the first right arc track are respectively arranged on the upper surface of the first car body;

the second rolling frame comprises a second left arc track and a second right arc track which are parallel to each other; the second left arc track and the second right arc track are respectively arranged on the upper surface of the second car body;

the third rolling frame comprises a third left arc track and a third right arc track which are parallel to each other; the third left arc track and the third right arc track are respectively arranged on the upper surface of the third car body;

the second curved plate is located between the first left arc track and the first right arc track; and the third curved plate is located between the second left arc track and the second right arc track.

6. The rollable toy car according to claim 1, wherein the second car body is provided with at least one side-tumbling flange; and a thickness of the side-tumbling flange gradually decreases along a direction away from the second car body to form a side inclination slope.

7. The rollable toy car according to claim 1, wherein the rollable toy car further comprises a turning actuating device; the turning actuating device comprises a turning actuating motor, a turning actuating gear that is in actuating connection to the turning actuating motor, a turning wobble gear meshed with the turning actuating gear, a turning member slidably pressing against the turning wobble gear, and a turning wheel arranged on the turning member;

the actuating motor actuates the turning wobble gear to rotate by means of the turning actuating gear; the turning wobble gear drives the turning member to rotate; the turning wheel is driven to rotate by the turning member;

wherein the actuating motor and the turning member are respectively arranged on the first car body, or the actuating motor and the turning member are respectively arranged on the third car body.

8. The rollable toy car according to claim 7, wherein a sliding rod is arranged on the turning member; the sliding rod is arranged in the turning wobble gear in a penetrating manner; and when the turning wobble gear rotates, the sliding rod drives the turning member to rotate under the actuation of the turning wobble gear.

9. The rollable toy car according to claim 7, wherein the turning wobble gear comprises a fan-shaped plate, and turning wobble teeth arranged at an edge of the fan-shaped plate;

the fan-shaped plate is connected to the first car body or the third car body through a rotating shaft; and the turning wobble teeth are meshed with the turning actuating gear.

10. The rollable toy car according to claim 1, wherein the rollable toy car further comprises a movement actuating device used for actuating the car body device to move;

the movement actuating device comprises a movement actuator, and a movement wheel that is in actuating connection to the movement actuator; the movement actuator actuates the movement wheel to rotate; and the movement actuator and the movement wheel are arranged on the first car body, or the movement actuator and the movement wheel are arranged on the third car body.

* * * * *